United States Patent [19]

Norris

[11] 4,168,410

[45] Sep. 18, 1979

[54] MOTION SENSING ALARM SWITCH

[76] Inventor: Albert B. Norris, 2845 Bulkner Ct., Stockton, Calif. 95207

[21] Appl. No.: 767,850

[22] Filed: Feb. 11, 1977

[51] Int. Cl.[2] ..... H01H 35/10

[52] U.S. Cl. ..... 200/61.45 R; 200/61.45 M; 200/61.93

[58] Field of Search ..... 200/61.45 R, 61.45 M, 200/61.11, 61.52, DIG. 29, 276, 52 R, 61.53

[56] References Cited

U.S. PATENT DOCUMENTS

| | | | |
|---|---|---|---|
| 1,341,267 | 5/1920 | East | 200/DIG. 29 |
| 1,656,704 | 1/1928 | Golombowski | 200/61.52 |
| 2,091,148 | 8/1937 | Hughes et al. | 200/61.52 |
| 2,898,415 | 8/1959 | Clurman | 200/61.45 |
| 2,898,416 | 8/1959 | Clurman et al. | 200/61.45 |
| 2,997,557 | 8/1961 | Gillmor et al. | 200/61.45 M |
| 3,108,252 | 10/1963 | Torres | 200/61.53 X |
| 3,161,737 | 12/1964 | Hall | 200/61.52 |
| 3,161,738 | 12/1964 | Hall | 200/61.52 |
| 3,217,120 | 11/1965 | Bowen et al. | 200/61.52 |
| 3,295,101 | 12/1966 | Ellis | 200/61.45 R X |
| 3,927,286 | 12/1975 | Föhl | 200/61.45 R |

OTHER PUBLICATIONS

Cummings, T. F.; IBM Tech. Disc. Bull.; "Ball Switch", vol. 15, No. 7, 12-1972, pp. 2207, 2208.

*Primary Examiner*—James R. Scott
*Attorney, Agent, or Firm*—Jackson, Jones & Price

[57] ABSTRACT

An anti-theft alarm device for household items is disclosed. The device employs a motion sensor unit subject to magnetic control such that the alarm may be disabled, set to go off or reset after being sounded. The magnetic control is applied by a magnetic probe to a conductive ball sensor normally maintained on a non-conductive area between conducting surfaces of opposite polarity. When magnetic attraction is removed the ball is free to respond to motion and complete an alarm circuit. A mounting casing is provided, which may be used to mount the motion sensing unit and alarm circuit in a compact apparatus. Additional mounting hardware is provided to enable mounting the motion sensing unit on angulated or curved surfaces. The magnetic control functions may be set by radio control.

7 Claims, 10 Drawing Figures

FIG. 4
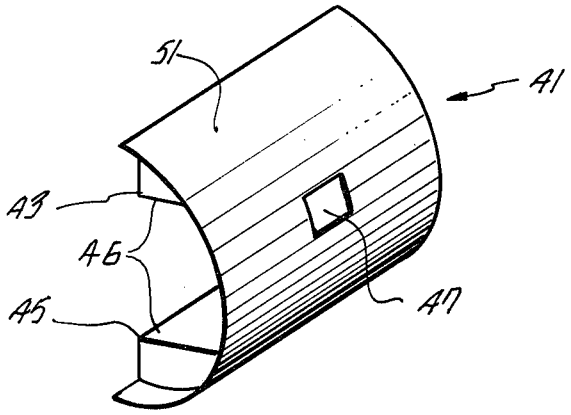
FIG. 5
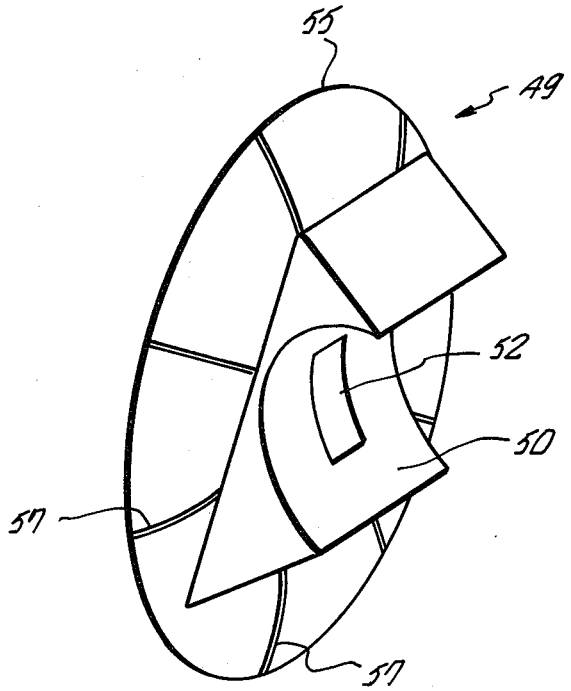
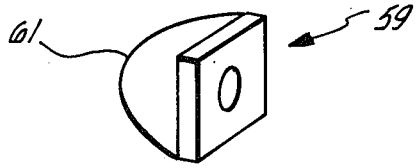
FIG. 6

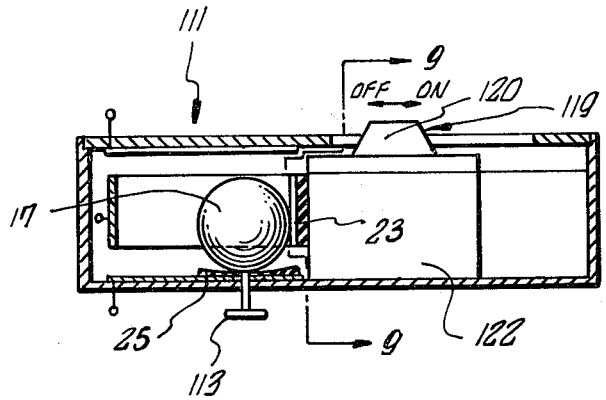
FIG. 8
FIG. 10
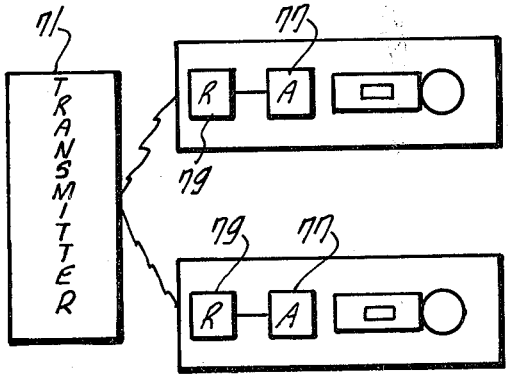
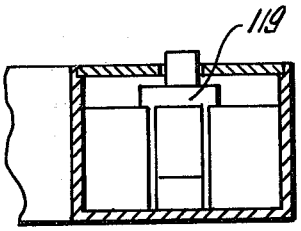
FIG. 9
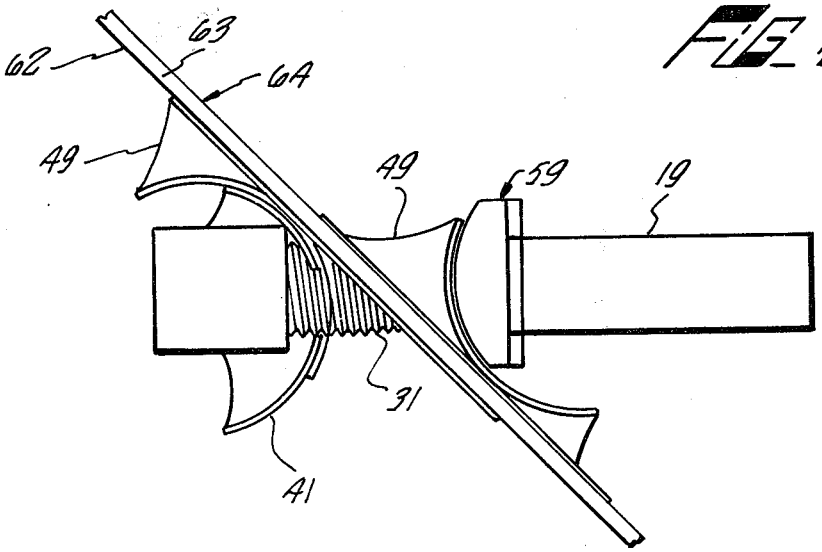
FIG. 7

MOTION SENSING ALARM SWITCH

BACKGROUND OF THE INVENTION

The subject invention relates to alarms and more particularly to an alarm system which senses the motion of an article to which it is attached. Particularly, the alarm is adaptable to remote control and is designed to be useful with household items such as televisions, stereos, and so forth.

With the ever increasing frequency of burglaries and housebreakings, the need has become apparent to protect the objects of such crimes, typically easily transportable and readily marketable household items such as television sets and sound system equipment. Up to this point, a simple and effectively controllable warning switch for indicating the displacement of a number of such household items from their normal position in the event of a theft has not been available. Ideally, such warning devices should embody a disabling control since the homeowner may desire to move household items for cleaning or other purposes without triggering an alarm. To be convenient, the capability to set a number of such devices at once throughout a home is desirable. Moreover, the devices need to be easily mountable in a variety of locations to adapt to various household devices.

To date, motion sensing devices have been provided which detect abnormal motion changes or accelerations above a certain level. U.S. Pat. No. 3,927,286 is an example. Such devices are typically overcomplex for the application here envisioned and do not provide the mounting flexibility and controlled resetting and arming features necessary in a practical home device. Neither have such devices been adapted to remote control so as to enable multiple devices to be easily reset by automatic means.

SUMMARY OF THE INVENTION

It is therefore an object of the invention to provide an improved alarm device.

It is another object of the invention to provide an inexpensive alarm device which may be used in multiple numbers to protect household items from theft.

It is a further object of the invention to provide an alarm which will detect the slightest motion but which is yet positively settable and resettable by an inexpensive means.

It is a further object to provide such an alarm device adapted for remote control purposes.

It is yet another object of the invention to provide an alarm device which is mountable in the variety of orientations necessary in order to protect a variety of household items.

These and other objects of the invention are achieved by a motion sensor unit including a compartment having conductive areas and a nonconductive resting area located at one portion of the compartment. A motion sensor element attractable by magnetic force and having a conductive surface is held normally in a nonconductive position by an adjacent magnetic field source. The magnetic field source may be controlled such that magnetic force may be selectively applied to the sensor element. When the alarm is armed by removing the magnetic field control from the sensor element, any movement of the device will result in the sensor element leaving its insulated position and contacting conductive areas of the compartment, thereby completing an alarm circuit. The alarm circuit then activates an appropriate warning device.

According to another aspect of the invention, a case for the motion sensing unit is provided with a complementary compartment for removably mounting the motion sensor unit in various orientations. According to yet another aspect of the invention the motion sensor unit is provided with mounting means designed to allow the motion sensing unit to successfully operate on curved and angulated surfaces.

BRIEF DESCRIPTION OF THE DRAWINGS

The preferred embodiment and best mode presently contemplated for practicing the just summarized invention will now be described in detail in conjunction with the drawings of which:

FIG. 4 illustrates a sensing unit frame for use in mounting the motion sensing unit to angulated or curved surfaces.

FIG. 5 illustrates a panel mounting bracket for use in conjunction with the frame of FIG. 4.

FIG. 6 illustrates a lock nut used with the apparatus of FIGS. 4 and 5 to secure the motion sensing unit of the preferred embodiment in place.

FIG. 7 is a schematic view illustrating the use of the hardware of FIGS. 4–6 to attach a motion sensing unit to an angulated surface.

FIG. 8 illustrates a side sectional view of an alternative motion sensing unit structure.

FIG. 9 is a side sectional view of the magnetic actuator of FIG. 8.

FIG. 10 illustrates an adaptation of the preferred embodiment of the invention to remote control.

DETAILED DESCRIPTION OF THE PREFERRED EMBODIMENT

Figure 1:
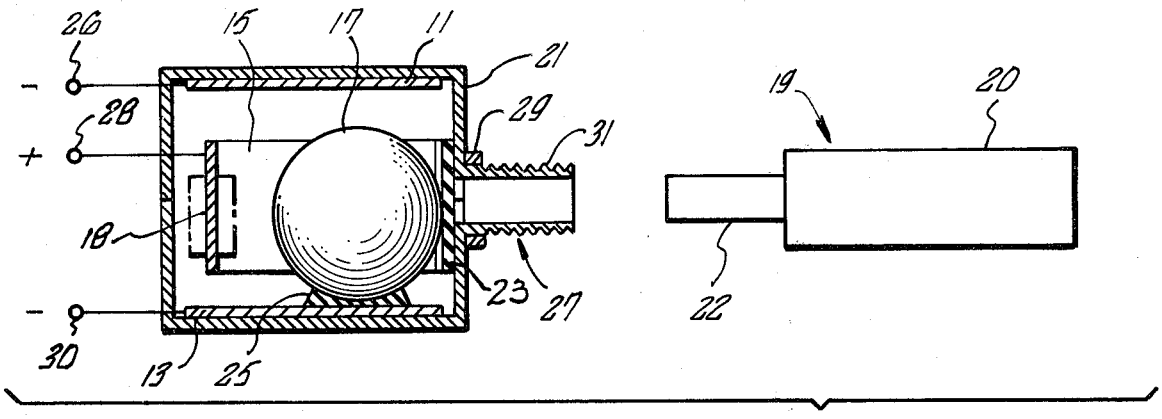
FIG. 1 is a side sectional view of the motions sensing unit of the preferred embodiment of the invention.
Figure 2:
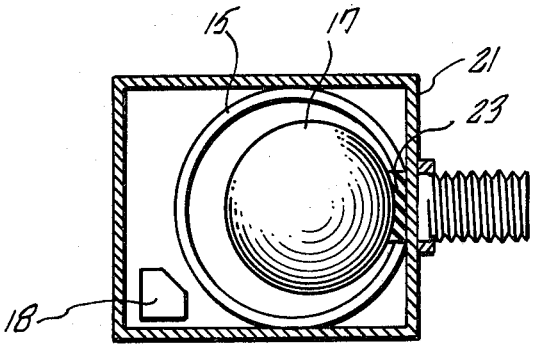
FIG. 2 is a top sectional view of the motions sensing unit of the preferred embodiment of the invention.

FIGS. 1 and 2 illustrate the motion sensing unit used in the preferred embodiment of the alarm device of the subject invention. This unit includes upper and lower conductive plates 11, 13, a conductive ring 15, and a conductive ball 17, all of which are mounted within a cubical housing 21. While a cubical shape is preferred for the sensing unit, other shapes could be used according to the invention.

The ball 17 is prefarably copper plated steel. The copper ring 15 surrounding the ball 17 is cylindrical in shape and not entirely closed, leaving a gap at one side of the ring 15. That gap is filled by an insulating pad 23.

The thin copper plates 11 and 13 mounted above and below the ring are preferably substantially circular and in conformance with the diameter of the ring. They are spaced from the ring by the square dimension of the housing 21 such that the ball 17 may rest on either surface 11 or 13 without touching the other surface 13, 11 but such that the ball 17 cannot pass through the openings between the plates 11, 13 and the ring 15. The ball then is effectively contained within the plates 11, 13 which are separated by an insulating air spaced from the ring 15. The plates 11, 13 and ring 15 effectively encase the ball 17. The second pad 25 is made concave to obtain a desired degree of insensitivity to motion when the alarm is armed.

The housing 21 has a hollow neck 27 which provides an opening into the housing 21 adjacent the gap in the copper ring occupied by the insulating pad 23. The neck may initially be square in cross section forming a nut 29. The nut 29 may then form integrally into a threaded shaft 31. The nut 29 and threaded shaft 31 facilitate locking the sensing unit into mounting apparatus as hereafter described. The interior of the neck 21 is dimensioned to receive a magnetic probe 19, which is preferably square in cross section.

The magnetic probe 19 is designed to control the ball 17 in the sensing unit. It includes a nonconductive, nonmagnetic handle 20, and a permanent magnet 22 affixed to the handle. As discussed above, the probe 19 is dimensioned to slide into and out of the interior of the housing neck 27. When the probe 19 is in place in the neck 27, the permanent magnet 22 rests adjacent the insulator pad 23.

With the probe 19 in place in the neck 27, the sensing unit is in a disarmed state. The permanent magnet 22 attracts the conductive ball 17 against the insulating pad 23 and maintains the ball 17 in position on the concave resting pad 25. In this state, motion will not be detected by the sensing unit.

To arm the alarm, the slideably mounted magnetic probe 19 is removed from the device. The ball 17 is then subject to no restraining force and the slightest perturbation of the housing 21 by a would-be thief will cause the ball to roll freely within the confines of the plates 11, 13 and the ring 15 and to thereby come under the influence of a small magnetic element 18. When the ball contacts one of the plates 11 or 13 and the ring 15, it closes a circuit path taken off leads shown schematically as 27, 29, 31. This circuit closing is then utilized to activate an alarm device. When it is desired to deactivate the alarm, the magnet probe 19 is moved back into the receptacle, attracting the ball 17 back to the nonconductive pads 23, 25 and opening the circuit. It may be noted, that, if desired, the ball itself could be connected to a lead and the plates 11, 13 eliminated. However, this structure is not preferred.

To insure a positive circuit closing when the ball 17 leaves the resting pad 25, the small magnet 18 is provided adjacent the conductive ring 15. This magnet 18 is insulated from the positive and negative electrode and is selected to have a force field which will not interfere with that applied by the control probe 19 when the control probe is in the disarming position.

Figure 3:
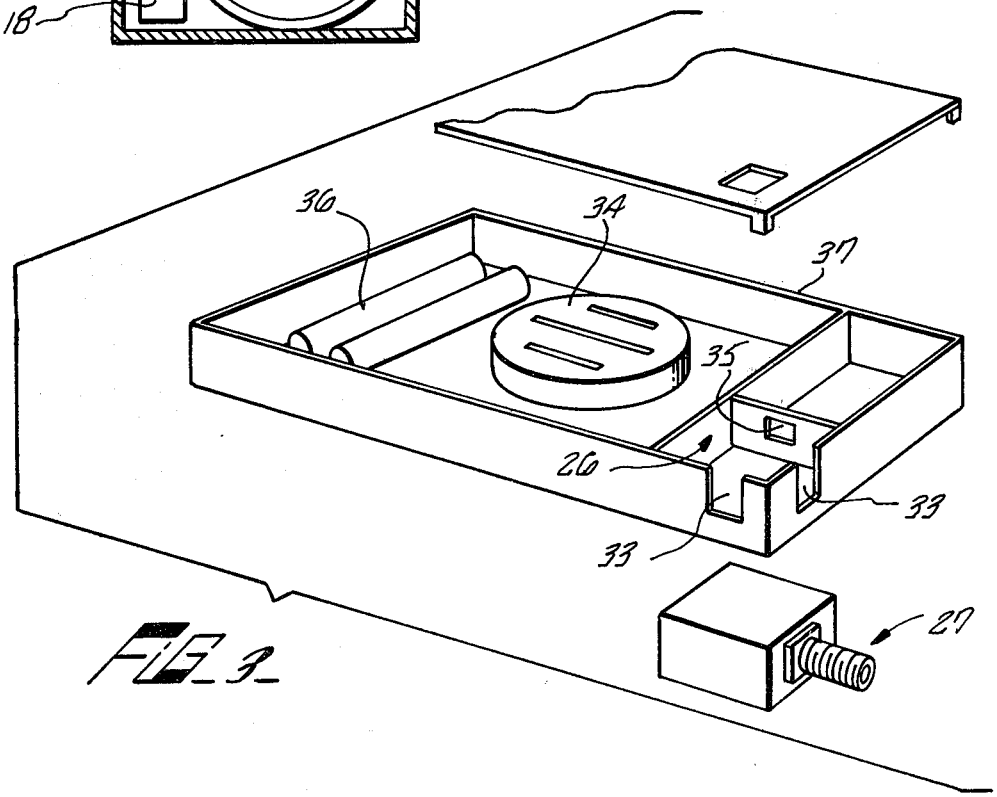
FIG. 3 illustrates an alarm device including a housing for mounting the motion sensing unit according to the preferred embodiment of the invention.

The particular advantage provided by the cubical sensor element of FIGS. 1 and 2 is illustrated in FIG. 3 where the sensor element is incorporated in an alarm device according to the preferred embodiment of the invention.

The alarm device of FIG. 3 includes a mounting compartment for the sensor unit and an alarm circuit. In the preferred embodiment, the mounting compartment 26 is cubical and open at one face to permit insertion of the motion sensor cube detailed above.

The mounting compartment further includes a number of slots 33 and openings 35, which are wide enough to receive the neck 27 of the probe receptacle of the sensor cube. By use of such openings 35 and the slots 33, the alarm device case 37 may be attached in horizontal or vertical positions with access to various of its sides cut off. By appropriately inserting the sensing unit cube and associated probe into the mounting compartment, the concave resting pad 25 of the sensing unit is properly oriented in a plane substantially perpendicular to the force of gravity. Without such positional flexibility, the alarm would be limited to one mounting position; otherwise, gravity would cause the ball 17 to fall off the concave pad 25.

To complete the alarm device of FIG. 3, an alarm circuit is provided including a warning device 34 connected for activation by a pair of batteries 36. The batteries 36 and the warning device 34 are connected in a circuit such that when the ball 17 closes a circuit between one of the pads 11, 13 and the conducitve ring 15 an energizing signal is applied to the warning device 34. The warning device 33 may be a speaker which emits a squawking sound, a bell, buzzer, horn, or other device. In a more sophisiticated version the warning device 34 could be a radio transmitter activated by the circuit closing.

Several advantages of the just described alarm device structure may be noted. First, the device may be mounted in various planes. Second, a special tool, the magnetic probe 19, is required to deactivate the device, adding to its fool proof nature. Third, the device may be mounted within a cabinet and an aperture provided for inserting and removing the magnetic control probe. Finally, the alarm device can be mounted remotely from the probe-controlled sensing unit.

As alluded to earlier, the limited space available in many models of television sets, stereos, radios, CB radios etc. may necessitate separation of the motion sensing unit from the alarm device. In many instances, the back panels of such appliances exhibit various angles and curved surfaces. To employ the magnetic probe 19 together with a sensing unit such as just described in connection with FIG. 1 and FIG. 2, it is necessary to mount the cube sensor on such curved and angulated surfaces such that the ball resting pad 25 is perpendicular to the gravitational force on the ball. The structure illustrated in FIGS. 4 through 7 accomplishes this task. This structure is designed to provide easy installation and adjustment as well as maximum adaptability to various surfaces.

FIG. 4 illustrates a sensing unit frame 41 preferably made of plastic and molded in halves to facilitate easy manufacture. The signal unit frame is concave in shape and bears first and second shelves 43, 45 which form a mounting receptacle 46 for the cubical sensing unit. An aperture 47 is provided to permit the threaded neck 31 of the sensor unit to protrude through the center of the concave mating surface 51 of the sensing unit frame 41. This aperture 47 may be made square to lock with the square portion 29 of the sensor unit neck 27. The signal unit frame 41 may be made of plastic halves which are cemented together to secure the cubical sensor unit within the mounting receptacle 46 of the sensing unit frame 41.

The sensing unit frame 41 cooperates with a second piece of mounting hardware, a panel mounting bracket 49 illustrated in FIG. 5. This bracket 49 includes a concave surface 50 complimentary to that of the rear surface 51 of the sensing unit frame 41. This concave surface 50 bears a long slot 52 through which the neck 27 of the motion sensing unit may pass. Attached to the back of the concave surface 50 of the panel mounting bracket 49 is a circular mounting flange 55 having radial indentations 57 therein.

The last element of the mounting hardware is a lock nut 59 illustrated in FIG. 6. This nut 59 has a rounded cap 61 forming integrally into a square nut. The nut 59 is designed to thread onto the shaft 31 of the sensing unit.

All mating surfaces of the components FIGS. 4, 5 and 6 are preferably rough or serrated to facilitate positive positioning. These surfaces include the signal unit frame mating surface 51, the panel mounting bracket mating surface 50, and the cap 61 of the lock nut 59.

FIG. 7 illustrates the use of the mounting hardware to mount a motion sensing unit on an angulated panel 63. A hole is drilled in the panel 63 to accomodate the neck 27 of the sensing unit. A panel mounting bracket 49 is located on the inner surface 62 of the panel 63, leveled and attached by cementing or by double sided adhesive tape. Another panel mounting bracket 49 is located on the outside 64 of the panel 63 and similarly attached. The two panel mounting brackets 49 are oriented respectively such that their slots 52 line up, permitting the threaded shaft 31 of the motion sensing unit to pass through both panel mounting brackets 49 and the hole drilled in the panel 63.

The sensing unit frame 41 is then installed through the hole in the panel and respective slots 52 of the panel mounting brackets 49. The mating surface 51 of the signal unit frame 41 mates with the concave surface 50 of the panel mounting bracket 49 permitting the surfaces 43, 45 of the mounting receptacle 46 to be maintained in a position perpendicular to the gravitational force vector. On the outside of the panel 63, the lock nut 59 is screwed on to the threaded shaft 31. The magnetic probe 19 is inserted into the neck 27 to retain the sensing unit in an "off" condition while these operations are taking place. The handle 20 of the magnetic probe 19 is then positioned to a horizontal level and secured at that level by the lock nut 59.

When it is desired to apply the panel mounting brackets 49 to curved surfaces, the circular flange 55 is cut along the indentations 57. This cutting provides the flexibility necessary for maximum surface contact when the mounting brackets 49 are attached.

FIGS. 8 and 9 illustrate an alternative motion sensing unit and associated control switch. This embodiment provides a slidable control probe mounted in a housing integrally formed with that containing a motion sensing unit, which may be constructed identically to that just described above. This sensing unit 111 is generally illustrated in FIG. 8 and will not be further detailed, other than to note the addition of an optional threaded adjustment plunger 113 to vary the amount of force necessary to jar the conductive ball from its resting platform.

To provide control of the ball 17 in the embodiment of FIG. 8, a slideable switch 119 is provided. This switch includes a nonconductive, nonmagnetic portion 120 and a permanent magnet element 122, which may be an Alnico magnet.

To arm the alarm, the slideably mounted magnetic switch 119 is moved to the "on" position. When it is desired to deactivate the alarm, the magnet switch 119 is moved back to the "off" position, attracting the ball 17 back to the nonconductive pads 23, 25. This sensor unit of FIGS. 8 and 9 may be used in connection with an alarm device as illustrated in FIG. 3.

Since, in practice, it may prove most effective to use multiple alarm devices configured according to the preferred embodiment in a single home, an embodiment particularly suited to such application is illustrated in FIG. 10. Since the alarm can be armed or reset by the simple sliding of the magnetic probe 19 or the magnetic actuating element 119, it is possible to accomplish arming and disarming with an actuator 77, which may be a well-known actuator such as a solenoid. The actuator 77 is then is turn activated by an output signal from a simple radio receiver 79 upon receiving a signal from a transmitter 71. Such transmitters and receivers are well-known elements of such systems as garage door closers. Thus, a homeowner merely has to press the "on" button on his transmitter to arm multiple warning devices throughout his home before leaving or retiring for the evening. Since the device of the preferred embodiment of the invention may be constructed of a dimension on the order of a cigarette package, it could be easily mounted in the interior of various household items, out of sight of a would-be thief and conveniently armed from without by means of the transmitter 71.

As may be apparent, many modifications may be made in the just disclosed preferred embodiment of the invention without departing from the spirit and scope thereof. Therefore, it is to be understood that, within the scope of the appended claims, the invention may be practiced other than as specifically described above.

What is claimed is:

1. An apparatus for triggering an alarm in response to motion, the apparatus comprrising:

a housing;

a non-conductive area in the housing, the non-conductive area including a recess;

a conductive ball incorporating material responsive to a magnetic field force, the ball dimensioned to interface with the recess and normally held therein in a resting position by the force of gravity, the ball capable of being at least partially dislodged from the recess in response to a movement of the housing;

at least a singular first contact element disposed substantially horizontally within the housing;

a second substantially circular contact element surrounding the ball without being in contact therewith when the ball is held in the recess, the first and second contact elements comprising terminals of an open electric circuit, and dimensioned to contact the ball when the ball is dislodged from the resting position whereby the ball closes the electric circuit and activates the alarm;

a magnet operatively positioned within the housing outside of the substantially circular second contact element, the magnet having insufficient field force to dislodge the ball from the recess but having sufficient field force to retain the ball in contact with the first and second contact elements after the ball has come into contact with the first and second contact elements, and control means mounted to the housing for providing options for retaining the ball in the resting position regardless of the movement of the housing, for releasing the ball to rest in the resting position wherein it is responsive to the movement of the housing, and for removing the ball from contact with the first and second contact elements and returning it into the resting position.

2. The invention of claim 1 wherein there are two first contact elements, one of the first contact elements being disposed below the ball, the second of the first contact elements being disposed above the ball, the first contact element comprising one of the terminals of the circuit.

3. The apparatus of claim 1 wherein said control means comprise magnetic means.

4. The apparatus of claim 3 wherein said magnetic means include a permanent magnet slideably mounted to the housing, the permanent magnet being movable to a first position wherein its magnetic force affects the ball and is capable of returning the ball to the resting position and keeping the ball in the resting position, the permanent magnet also being moveable to a second position where the force of said permanent magnet no longer affects said ball.

5. A motion sensitive switch for closing a circuit triggering an alarm, the switch comprising:

a housing having a bottom surface normally disposed in a horizontal position, and including a non-conductive area having a recess;

a first and a second contact element mounted within the housing and insulated from each other, said first and second contact elements comprising the terminals of the circuit and having an air gap between each other;

an electrically conductive and magnetically attractable ball dimensioned to interface with said recess and held therein by the force of gravity when the bottom surface is disposed substantially horizontally, the ball capable of being dislodged from the recess by movement of the housing in any direction having a component of movement parallel to the bottom surface, the ball bridging the air gap and coming into contact with the first and second contact elements as a result of the movement of the housing, whereby the circuit is closed and the alarm is triggered;

a magnet operatively mounted within the housing to retain the ball in contact with said first and second contact elements after it is dislodged from the recess, whereby the alarm circuit remains closed, said magnet having a force field insufficient to dislodge the ball from the recess, and selectively operable control means operatively connected to the housing providing options for retaining the ball in the recess whereby it is incapable of being dislodged from the same in response to movement of the housing, for releasing the ball whereby it becomes responsive to the movement of the housing, and for returning the ball into the recess thereby breaking the circuit and deactivating the alarm.

6. The motion sensitive switch of claim 5 wherein the control means comprise magnetic means.

7. The motion sensitive switch of claim 5 wherein the magnet is a permanent magnet.

* * * * *

UNITED STATES PATENT AND TRADEMARK OFFICE

CERTIFICATE OF CORRECTION

PATENT NO. : 4,168,410

DATED : September 18, 1979

INVENTOR(S) : Albert B. Norris

It is certified that error appears in the above-identified patent and that said Letters Patent are hereby corrected as shown below:

Column 4, line 14, delete "33" and insert --34-- therein.

Signed and Sealed this

*Eleventh* Day of *December 1979*

[SEAL]

*Attest:*

SIDNEY A. DIAMOND

*Attesting Officer*

*Commissioner of Patents and Trademarks*